United States Patent [19]

Harkey

[11] Patent Number: 4,991,809

[45] Date of Patent: Feb. 12, 1991

[54] MUSICAL INSTRUMENT SUPPORT

[76] Inventor: James R. Harkey, P.O. Box 714, Tishomingo, Okla. 73460

[21] Appl. No.: 435,065

[22] Filed: Nov. 13, 1989

[51] Int. Cl.[5] ..... A47B 96/00

[52] U.S. Cl. ..... 248/231.4; 84/327; 248/229; 248/231.2; 248/316.4

[58] Field of Search ..... 248/231.4, 229, 231.2, 248/316.4; 84/327, 453

[56] References Cited

U.S. PATENT DOCUMENTS

| | | | |
|---|---|---|---|
| 2,517,896 | 8/1950 | Lawrence . | |
| 2,697,572 | 12/1954 | Pfankuch | 248/231.4 X |
| 2,761,346 | 9/1956 | Kuchler et al. . | |
| 3,030,060 | 4/1962 | Breuer | 248/316.4 X |
| 3,370,816 | 2/1968 | Michaud . | |
| 3,664,224 | 5/1972 | Campagna, Jr. . | |
| 3,765,633 | 10/1973 | Caudill . | |
| 3,841,191 | 10/1974 | Jaras . | |
| 3,958,786 | 5/1976 | Mann . | |
| 4,176,580 | 12/1979 | Gallegos . | |
| 4,546,688 | 10/1985 | Cuccio . | |
| 4,575,149 | 3/1986 | Forestal et al. | 248/231.4 X |
| 4,691,610 | 9/1987 | Gilbert . | |

*Primary Examiner*—Ramon O. Ramirez

*Attorney, Agent, or Firm*—Dunlap, Codding, Peterson & Lee

[57] ABSTRACT

A musical instrument support removably connectable to a support having a first clip engageable with a portion of the support and a clip means connectable to a portion of the support and spaced a distance from the first clip. Stretch means are connected to the first clip and the clip means for stretchably connecting the first clip to the clip means. Support means are on the first clip for cooperating with the support to support a musical instrument.

20 Claims, 3 Drawing Sheets

MUSICAL INSTRUMENT SUPPORT

FIELD OF THE INVENTION

A musical instrument support having a first clip and clip means connected via a stretch means whereby the first clip and the clip means are stretchable to increase the distance therebetween for connecting the first clip and the clip means to a support, the stretch means biasing the first clip generally toward the clip means for maintaining the first clip and the clip means connected to the support or amplifier.

DESCRIPTION OF THE PREFERRED EMBODIMENTS

Figure 1:
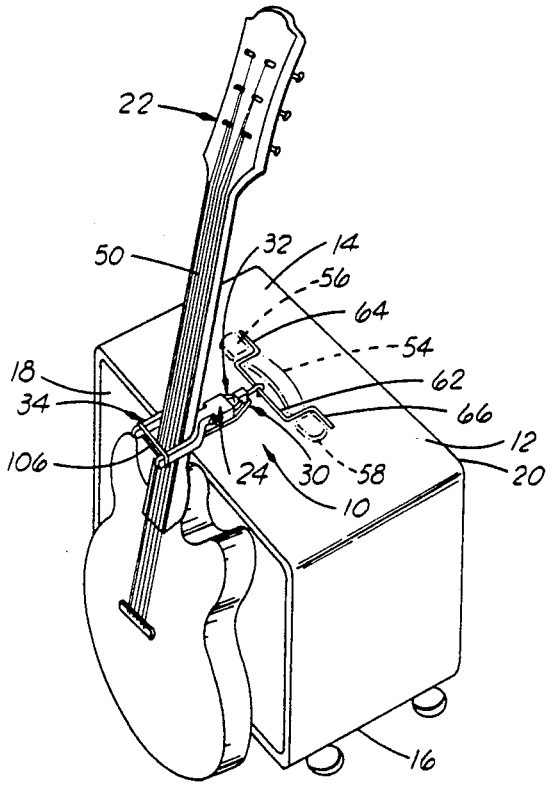
FIG. 1 is a partial perspective view showing a support in the form of an amplifier and showing a musical instrument support removably connected to the amplifier with a neck of a guitar removably supported in the musical instrument support.
Figure 2:
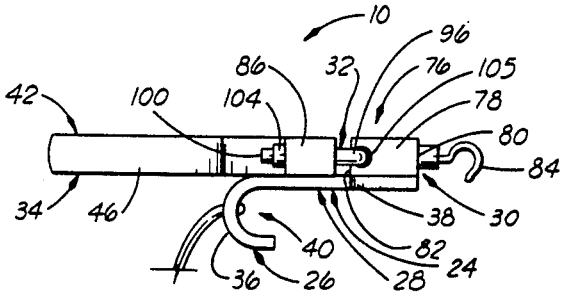
FIG. 2 is a side elevational view of the musical instrument support of FIG. 1, but not showing a clip bar (shown in FIG. 1) portion of the musical instrument support.
Figure 3:
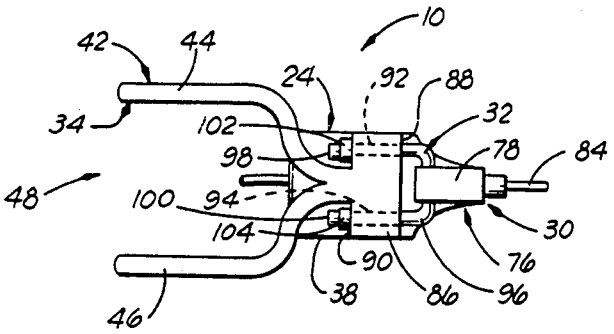
FIG. 3 is a top plan view of the musical instrument support of FIG. 1, but not showing a clip bar (shown in FIG. 1) portion of the musical instrument support.

Referring to the drawings in general and to FIGS. 1, 2 and 3 in particular, shown therein and designated therein by the general reference numeral 10 is a musical instrument support constructed in accordance with the present invention. The musical instrument support 10 is removably connectable to a support or, more particularly, an amplifier 12 (shown in FIG. 1) having an upper surface 14, a lower surface 16, a front face 18, and a rear face 20. The musical instrument support 10 is adapted to cooperate with the amplifier 12 for removably supporting a musical instrument or, more particularly, a guitar 22 (FIG. 1).

As shown in FIGS. 1, 2 and 3, the musical instrument support 10 includes a first clip 24 having a first portion 26 (FIG. 2) engageable with a portion of the front face 18 of the amplifier 12 and a second portion 28 (FIG. 2) which extends a distance generally over a portion of the upper surface 14 of the amplifier 12. The musical instrument support 10 also includes a clip means 30 which is connectable to a portion of the amplifier 12. The clip means 30 is spaced a distance from the first clip 24.

Stretch means 32 are connected to the second portion 28 of the first clip 24 and connected to a portion of the clip means 30. The stretch means 32 stretchably connects the first clip 24 to the clip means 30 whereby the first clip 24 and the clip means 30 are stretchable in opposite directions thereby extending a distance generally between the first clip 24 and the clip means 30. In a stretched condition wherein the distance between the first clip 24 and the clip means 30 is increased, the musical instrument support 10 is connected to the amplifier 12. The stretch means 32 then biases the first clip 24 generally toward the clip means 30 for cooperating to maintain the first clip 24 engaged with the amplifier 12 and the clip means 24 connected to the amplifier 12.

The musical instrument support 10 also includes support means 34 on the first clip 24. The support means 34 is adapted to cooperate for supporting the guitar 22 when the first clip 24 is engaged with the amplifier 12 and the clip means 30 is connected to the amplifier 12.

The first clip 24 includes a clip lip 36 (FIG. 2) and a clip plate 38 (FIGS. 2 and 3). One end of the clip lip 36 is connected to one end of the clip plate 38. The clip lip 36 extends a distance from the clip plate 38. The clip lip 36 is articulately shaped and extends in an arc generally outwardly and downwardly from the clip plate 38 forming a clip receiving space 40 (FIG. 2).

When the first clip 24 is connected to the amplifier 12, the clip lip 36 extends a distance generally over a portion of the front face 18 of the amplifier 12 and the clip lip 36 generally engages a portion of the front face 18 of the amplifier 12. More particularly, a portion of the amplifier 12, generally near the upper surface 14 thereof, is disposed in the clip receiving space 40 of the clip lip 36 when the first clip 24 is connected to the amplifier 12. When the first clip 24 is connected to the amplifier 12, the clip plate 38 extends a distance from the clip lip 36 and extends a distance generally over the upper surface 14 of the amplifier 12. The stretch means 32, more particularly, is connected to one end of the clip plate 38, generally opposite the end of the clip plate 38 having the clip lip 36 connected thereto.

As shown in FIGS. 2 and 3, the support means 34, more particularly, comprises a U-shaped yoke 42 having a first yoke leg 44 and a second yoke leg 46. The yoke leg 44 is spaced a distance from the second yoke leg 46 and the space between the first and the second yoke legs 44 and 46 forms a receiving space 48 (FIG. 31. The receiving space 48 is sized to receive a portion of a neck 50 (FIG. 1) of the guitar 22 when the guitar 22 is supported in the musical instrument support 10. The yoke 42 is connected to the upper surface of the clip plate 38.

As shown in FIG. 1, the amplifier 12 includes a handle 54 having opposite ends 56 and 58. The opposite ends 56 and 58 of the handle 54 are connected to the upper surface 14 of the amplifier 12. The opposite ends 56 and 58 of the handle 54 are spaced a distance apart thereby forming a handle space generally between the handle 54 and the adjacent portion of the upper surface 14 of the amplifier 12.

The musical instrument support 10 includes a clip bar 62 having a first end 64 and a second end 66. The first end 64 of the clip bar 62 is formed in an L-shape thereby providing a first portion extending generally at a right angle from the clip bar 62 and a second portion extending generally at a right angle from the first portion 68.

The second end 66 of the clip bar 62 is formed in an L-shape thereby providing a first portion extending generally at a right angle from the clip bar 62 and a second portion extending generally at a right angle from the second portion.

The clip bar 62 comprises a portion of the clip means 30. The clip means 30 also includes a clip hook assembly 76 (FIGS. 2 and 3), sometimes referred to herein as clip hook means. The clip hook assembly 76 includes a hook base 78 (FIGS. 2 and 3) having opposite ends 80 (FIG. 2) and 82 (FIG. 2). One end of a hook 84 is connected to the end 80 of the hook base 78. The hook 84 extends a distance from the end 80 of the hook base 78 and is shaped in the form of a hook. The stretch means 32 is connected to the end 82 of the hook base 78.

A clip base 86 (FIGS. 2 and 3) is connected to a portion of the upper surface of the clip plate 38 and disposed generally near the end of the clip plate 38, opposite the end having the clip lip 36 connected thereto. The clip base 86 has a first side 88 (FIG. 3) and a second side 90 (FIG. 3). A first opening 92 (FIG. 3) is formed through the clip base 86 and the first opening 92 extends through the clip base 86 intersecting the first and the second sides 88 and 90 thereof. A second opening 94 (FIG. 3) is formed through the clip base 86 and the second opening 94 extends through the clip base 86 intersecting the first and the second sides 88 and 90 thereof.

The stretch means 32, more particularly, comprises a tubular, elastomeric member 96 (FIGS. 2 and 3) having opposite ends 98 and 100. The elastomeric member 96 has an opening extending therethrough and intersecting the opposite ends 98 and 100 thereof.

A portion of the elastomeric member 96 generally near the end 98 thereof is disposed through the first opening 92 to a position wherein a portion of the elastomeric member 96 generally near the end 98 thereof extends a distance generally from the second side 90 of the clip base 86. In this position, a stop 102 (FIG. 3) is disposed through the opening in the elastomeric member 96 generally at the end 98 thereof. The stop 102 is larger than the diameter of the first opening 92 and cooperates to secure the end 98 of the elastomeric member 96 connected to the clip base 86.

A portion of the elastomeric member 96 generally near the end 100 thereof is disposed through the second opening 94 to a position wherein a portion of the elastomeric member 96 generally near the end 100 thereof extends a distance generally from the second side 90 of the clip base 86. In this position, a stop 104 is disposed through the opening in the elastomeric member 96 generally at the end 100 thereof. The stop 104 is larger than the diameter of the second opening 94 and cooperates to secure the end 100 of the elastomeric member 96 connected to the clip base 86.

The elastomeric member 96 extends through an opening 105 (FIG. 2) in the hook base 78 thereby connecting the elastomeric member 96 to the hook base 78.

In operation, the first end 64 and the second end 66 of the clip bar 62 is inserted through the handle space to a position wherein the second portion 70 of the end 64 is disposed generally on one side of the handle 54 generally near the end 56 thereof and the second portion of the end 66 is disposed generally on one side of the handle 54 generally near the end 58 thereof. An individual then hooks the hook 84 generally over the clip bar 62 and pulls the first clip 24 in a direction generally away from the hook base 78 to a position wherein the clip lip 36 of the first clip 24 is disposed generally over a portion of the front face 18 of the amplifier 12 generally near the upper surface 14 of the amplifier 12. In this position, the first clip 24 is released and the elastomeric member 96 stretchably pulls or biases the first clip 24 generally toward the hook base 78 to a position wherein a portion of the amplifier 12 is disposed in the clip receiving space 40, the clip lip 36 generally engaging a portion of the front face 18 of the amplifier 12 in this position. In this position, the clip lip 36 of the first clip 24 extends generally over a portion of the front face 18 of the amplifier 12 and the clip lip 36 engages a portion of the front face of the amplifier 12, the clip plate 38 extending a distance generally over the upper surface 14 of the amplifier 12. The elastomeric member 96 biases the first clip 24 generally toward the hook base 78 thereby maintaining the clip lip 36 engaged with the front face 24 of the amplifier 12 and maintaining the hook 84 connected to the clip bar 62 thereby maintaining the musical instrument support 10 connected to the amplifier 12. In this position, a portion of the neck 50 of the guitar 22 is disposable generally within the receiving space 48 for cooperating to support the guitar 12 in a generally upright position. When the guitar 12 has been disposed in the receiving space 48, an elastomeric band 106 (FIG. 1) is connected to the first yoke leg 44 and the second yoke leg 46 to secure the neck 50 of the guitar 22 in the receiving space 48. The elastomeric band 106 extends generally between the first and the second yoke legs 44 and 46.

The clip bar 62 and the clip hook assembly 76 comprise the clip means 30 in this embodiment of the musical instrument support 10.

EMBODIMENT OF FIGS. 4, 5 AND 6

Figure 4:
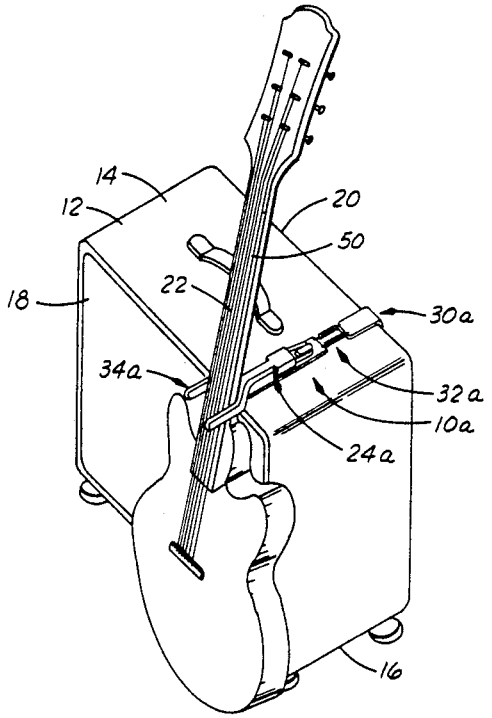
FIG. 4 is a partial perspective view of a support in the form of an amplifier, similar to FIG. 1, but showing a modified musical instrument support removably connected to the amplifier and showing a guitar removably supported in the musical instrument support.
Figure 5:
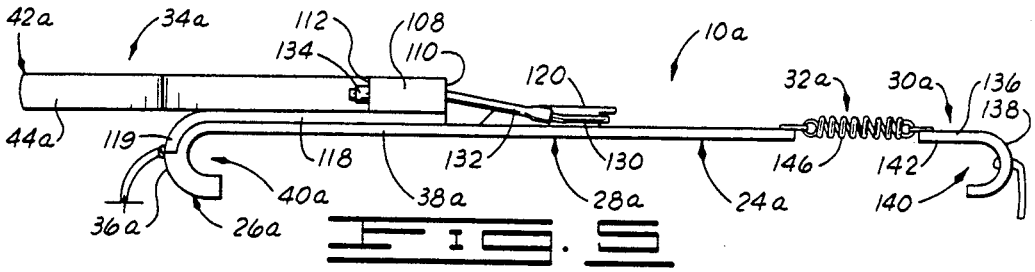
FIG. 5 is a side elevational view of the musical instrument support of FIG. 4.
Figure 6:
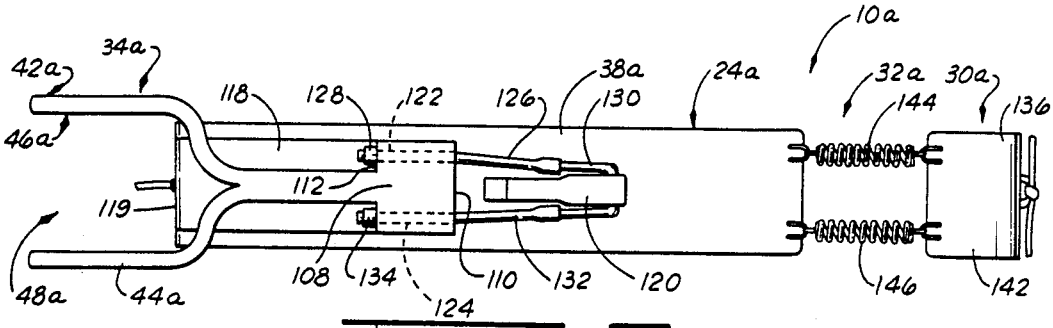
FIG. 6 is a top plan view of the musical instrument support of FIG. 4.

Shown in FIGS. 4, 5 and 6 is a modified musical instrument support **10*a* having a modified first clip 24*a* and a modified clip means 30*a***.

The first clip **24*a* is constructed exactly like the first clip 24 described in detail before, except the modified first clip 24*a* has an extended clip plate 38*a*, the yoke 42*a* is connected to the clip plate 38*a* in a different manner as compared to the yoke 42 and the clip plate 38 and a modified stretch means 32*a* is connected to the clip plate 38*a* in a different manner as compared to the clip plate 38 and the stretch means 32**.

A yoke base 108 is connected to an extended portion of the yoke **42*a*. The yoke base 108 has a first side 110 and a second side 112. The yoke base 108 with the yoke 42*a* connected thereto is secured to the upper surface of a yoke plate 118. The yoke plate 118 is slidably supported on the upper surface of the clip plate 38*a*. An end 119 of the yoke plate 118 is disposed in a recess formed in an end of the clip plate 38*a* for securing one end of the yoke plate 118 connected to the clip plate 38*a*. A yoke bar 120 is connected to the upper surface of the clip plate 38*a***.

A first opening 122 is formed through the yoke base 108 intersecting the first and the second sides 110 and 112. A second opening 124 is formed through the yoke base 108 intersecting the first and the second sides 110 and 112. One end of a first elastomeric tube 126 is disposed through the first opening 122 to a position wherein one end of the first elastomeric tube 126 extends a distance generally beyond the second side 112 of the yoke base 108. A stop 128 is disposed in the opening in the first elastomeric tube 126. The stop 128 is larger than the first opening 122 thereby securing the first elastomeric tube 126 from movement in one direction for cooperating to connect one end of the first elastomeric tube 126 to the yoke base 108. The opposite end of the first elastomeric tube 126 is secured to a U-shape retainer 130.

The opposite end of the U-shape retainer 130 is connected to one end of a second elastomeric tube 132. The opposite end of the second elastomeric tube 132 extends through the second opening 124 and the yoke base 108 to a position wherein the end of the second elastomeric tube 132 extends a distance beyond the second side 112 of the yoke base 108. In this position, a stop 134 is disposed through the opening in the second elastomeric tube 132 for cooperating to secure the end of the elastomeric tube 132 connected to the yoke base 108.

In operation, the yoke plate 118 with the yoke **42*a* connected thereto is disposed generally on the upper surface of the clip plate 38*a* and the U-shape retainer 130 is stretchably pulled generally away from the yoke base 108 to a position wherein the U-shape retainer 130 is disposed over the yoke bar 120. The yoke 42*a* is removably connected to the clip plate 83*a***.

The clip means **30*a*, more particularly, comprises a second clip 136. The second clip 136 includes an arcuately shaped clip lip 138 forming a clip receiving space 140. The second clip 136 also includes a clip plate 142 having opposite ends. One end of the clip plate 142 is connected to the clip lip 138**.

The stretch means **32*a* more particularly comprises a first spring 144 and a second spring 146. One end of the first spring 144 is connected to the clip plate 38*a* and the opposite end of the second spring 144 is connected to the clip plate 142 of the second clip 136. One end of a second spring 146 is connected to the clip plate 38*a* and the opposite end of the second spring 146 is connected to the clip plate 142 of the second clip 136**.

In operation, the clip lip 138 of the second clip 136 is disposed generally over a portion of the rear face 20 to a position wherein a portion of the amplifier 12 extends into the clip receiving space 140, the clip lip 138 engaging portion of the rear face 20 of the amplifier 12. The first clip **24*a* then is pulled in a direction generally away from the second clip 136 is thereby stretching the spring 144 and 146 and moving the first clip 24*a* to a position wherein the clip lip 36*a* is disposed over and engages a portion of the front face 18 of the amplifier 12 with a portion of the amplifier 12 being disposed generally within the clip receiving space 40*a*. In this position, the springs 144 and 146 generally bias the first clip 24*a* generally toward the second clip 136 thereby maintaining the first and the second clips 24*a* and 136 engaged with the amplifier 12. The guitar 24 is supportable generally within the yoke 42*a* in a manner like that described before with respect to the yoke 42 shown in FIG. 1**.

EMBODIMENT OF FIGS. 7 AND 8

Figure 7:
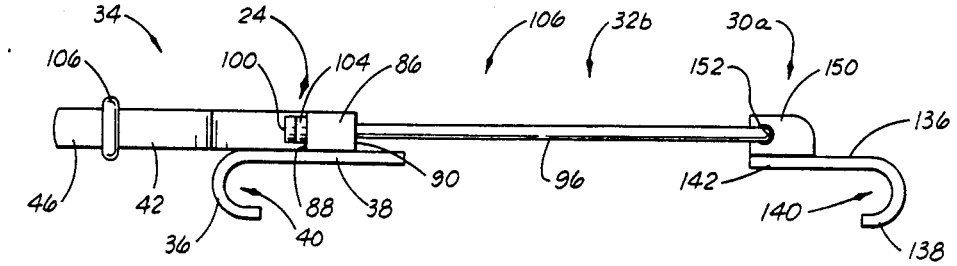
FIG. 7 is a side elevational view of another modified musical instrument support.
Figure 8:
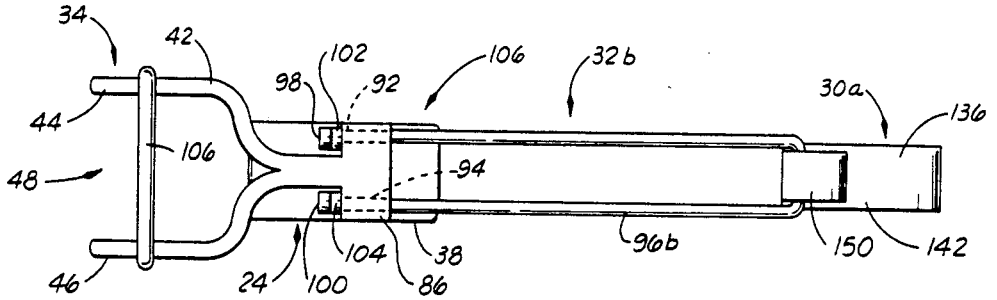
FIG. 8 is a top plan view of the modified musical instrument support of FIG. 7.

Shown in FIGS. 7 and 8 is a musical instrument support **10*b* which includes the first clip 24 having the yoke 42 connected thereto which is constructed exactly like the first clip 24 and the yoke 42 shown in FIGS. 1, 2 and 3 and the second clip 136 which is constructed exactly like the second clip 136 shown in FIGS. 4, 5 and 6. A connector 150 is secured to the upper surface of the clip plate 142 and an opening 152 is formed through a portion of the clip plate 152. The elastomeric member 96 extends through the opening 152 thereby connecting the first clip 24 to the second clip 136**.

EMBODIMENT OF FIGS. 9 AND 10

Figure 9:
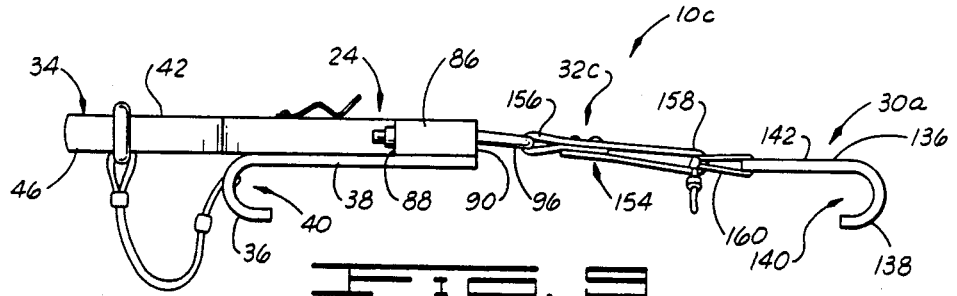
FIG. 9 is a side elevational view of yet another modified musical instrument support.
Figure 10:
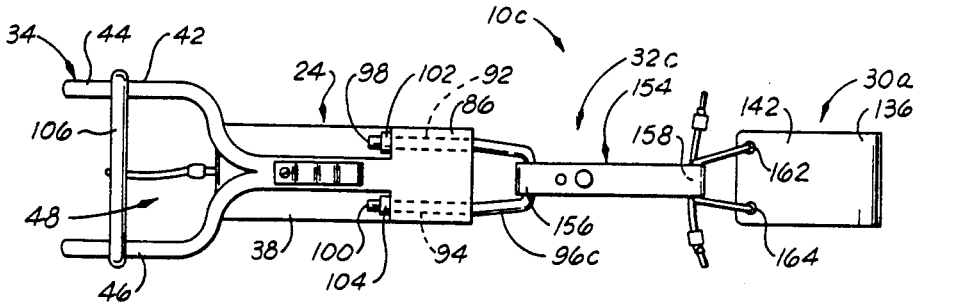
FIG. 10 is a top plan view of the modified musical instrument support of FIG. 9.

Shown in FIGS. 9 and 10 is a modified musical instrument support **10*c* which includes the first clip 24 connected to the second clip 136 by way of a modified stretch means 32*c*. A shorten elastomeric member 96*c* is connected to the clip base 86 in a manner exactly like that described before with respect to the elastomeric member 96 in the clip base 86. The modified stretch means 32*c* includes a leather strap 154 having looped ends 156 and 158. The elastomeric member 96*c* extends through the looped end 156 thereby connecting the elastomeric member 96*c* to the leather strap 154. A strap 160 is connected to one end of the clip plate 142 via openings 162 and 164 in the clip plate 142 and the strap 160 is connected to the looped end 158 of the leather strap 154**.

The musical instrument support **10*c* will operate exactly like the musical instrument support 10*b*, except the elastomeric member 96*c* is connected to the clip plate 142 via the leather strap 154 and the strap 160**.

Changes may be made in the construction and the operation of the various components, elements and assemblies described herein without departing from the spirit and scope of the invention as defined in the following claims.

What is claimed is:

1. A musical instrument support removably connectable to a support having an upper surface, a front face and a rear face for cooperating with the support to support a musical instrument, comprising:

a first clip having a first portion engageable with a portion of the front face of the support and a second portion extending a distance generally over a portion of the upper surface of the support comprising:

a clip lip extendible over a portion of the front face of the support and engageable with a portion of the front face of this support and having opposite ends;

a clip plate having opposite ends with one end connected to one end of the clip lip and the clip plate extending from the clip lip a distance over the upper surface of the support; and a clip base connected to the clip plate; and clip means connectable to a portion of the support and spaced a distance from the first clip;

stretch means consisting of at least one of an elastomeric member and a spring connected to the clip base and to the clip means for stretchably connecting the first clip to the clip mans whereby the first clip and the clip means are stretchable in opposite directions thereby extending the distance therebetween so the first clip is disposable on the support and the clip means is connectable to the support, the stretch means biasing the first clip generally toward the clip means for maintaining the first clip engaged with the support and the clip means connected to the support; and support means on the first clip for cooperating to support the musical instrument when the first clip is engaged with the support and the clip means is connected to the support.

2. The musical instrument support of claim 1 wherein the clip means further comprises:

a second clip having a first portion engageable with a portion of the rear face of the support and a second portion extending a distance generally over a portion of the upper surface of the support, the stretch means being connected to the second portion of the second clip.

3. The musical instrument support of claim 1 wherein the clip lip is formed on an arc thereby forming a clip receiving space, and wherein a portion of the structure is disposable generally within the clip receiving space when the first clip is connected to the support.

4. The musical instrument support of claim 2 wherein the second clip further comprises:

a clip lip extendable over a portion of a rear face of the support and engageable with the portion of the rear face of the support and having opposite ends; and a clip plate having opposite ends with one end connected to one end of the clip lip and the clip plate extending from the clip lip the distance over the upper surface of the support, the stretch means being connected to the clip plate generally near the end thereof, opposite the end connected to the clip lip.

5. The musical instrument support of claim 4 wherein the clip lip is formed on an arc thereby forming a clip receiving space, and wherein a portion of the support is disposable generally within the clip receiving space when the first clip is connected to the support.

6. The musical instrument support of claim 1 wherein the support means further comprises:

a yoke having a portion forming a receiving space shaped and adapted to supportingly receive a portion of the musical instrument, the yoke being connected to the first clip and extending a distance therefrom.

7. The musical instrument support of claim 6 wherein the yoke is generally U-shaped having a first yoke leg and a second yoke leg with the space between the first and second yoke legs forming the receiving space, a portion of the musical instrument being disposable in the receiving space.

8. The musical instrument support of claim 7 further comprising:

means removably connectable to the first and the second yoke legs for closing the receiving space to substantially secure the musical instrument disposed in the receiving space.

9. The musical instrument support of claim 1 wherein the support is an amplifier and wherein the musical instrument is a guitar.

10. A musical instrument support removably connectable to a support having an upper surface, a front face and a rear face for cooperating with the support to support a musical instrument, comprising:

a first clip having a first portion engageable with a portion of the front face of the support and a second portion extending a distance generally over a portion of the upper surface of the support;

clip means connectable to a portion of the support and spaced a distance from the first clip;

stretch means connected to the second portion of the first clip and connected to a portion of the clip means for stretchably connecting the first clip to the clip means whereby the first clip and the clip means are stretchable in opposite directions thereby extending the distance therebetween so the first clip is disposable on the support and the clip means is connectable to the support, the stretch means biasing the first clip generally toward the clip means for maintaining the first clip engaged with the support and the clip means connected to the support;

support means on the first clip for cooperating to support the musical instrument when the first clip is engaged with the support and the clip means is connected to the support, comprising:

a handle means having a first end connected to the upper surface of the support and a second end connected to the upper surface of the support spaced a distance from the first end; and wherein the clip means further comprises:

a clip bar having a first end and a second end, the first end being removably connectable to the handle generally near the first end of the handle and the second end being removably connectable to the handle generally near the second end of the handle, the clip bar extending a distance generally between the first and second ends of the handle; and clip hook means removably connectable to the clip bar and the clip hook means being connected to the stretch means, whereby the first clip is engaged with the support and the clip hook means is stretchable to a position for being removably connected to the clip bar, the stretch means biasing the clip hook means generally toward the first clip.

11. The musical instrument support of claim 10 wherein the first clip further comprises:

a clip lip extendable over a portion of a front face of the support and engageable with the portion of the front face of the support and having opposite ends; and a clip plate having opposite ends with one end connected to one end of the clip lip and the clip plate extending from the clip lip the distance over the upper surface of the support, the stretch means being connected to the clip plate generally near the end thereof, opposite the end connected to the clip lip.

12. The musical instrument support of claim 11 wherein the stretch means further comprises:

at least one spring, each spring having opposite ends with one end being connected to the clip plate of the first clip and the opposite end being connected to the clip plate of the second clip.

13. The musical instrument support of claim 11 wherein the stretch means further comprises:

at least one elastomeric member, each elastomeric member having opposite ends with one end being connected to the clip plate of the first clip and the opposite end being connected to the clip plate of the second clip.

14. The musical instrument support of claim 11 wherein the support means further comprises:

a yoke having a portion forming a receiving space shaped and adapted to supportingly receive a portion of the musical instrument, the yoke being connected to the first clip and extending a distance therefrom.

15. The musical instrument support of claim 14 wherein the yoke is generally U-shaped having a first yoke leg and a second yoke leg with the space between the first and second yoke legs forming the receiving space.

16. The musical instrument support of claim 15 further comprising:

means removably connectable to the first and the second yoke legs for closing the receiving space to substantially secure the musical instrument disposed in the receiving space.

17. A musical instrument support removably connectable to a support having an upper surface, a front face and a rear face for cooperating with the support to support a musical instrument, comprising:

a first clip having a first portion engageable with a portion of the front face of the support and a second portion extending a distance generally over a portion of the upper surface of the support; and clip means connectable to a portion of the support and spaced a distance from the first clip;

stretch means connected to the second portion of the first clip and connected to a portion of the clip mans for stretchably connecting the first clip to the clip means whereby the first clip and the clip means are stretchable in opposite directions thereby extending the distance therebetween so the first clip is disposable on the support and the clip means is connectable to the support, the stretch means biasing the first clip generally toward the clip means for maintaining the first clip engaged with the support and the clip means connected to the support; and support means on the first clip for cooperating to support the musical instrument when the first clip is engaged with the support and the clip means is connected to the support; and wherein the first clip further comprises:

a clip lip having a first portion engageable with a portion of the front face of the support and a second portion extending a distance generally over a portion of the upper surface of the support; and a clip base connected to the clip lip and having a first side and a second side and having a first opening extending therethrough intersecting the first and the second sides and a second opening extending therethrough intersecting the first and the second sides; and wherein the stretch means further comprises:

an elastomeric member having opposite ends with one end of the elastomeric member extending through the first opening in the clip base and the opposite end of the elastomeric member extending through the second opening in the clip base; and means for securing the opposite ends of the elastomeric member in the first and the second openings in the clip base; and wherein the clip means further comprises:

a hook base with the elastomeric member being connected to the hook base;

a hook connected to the hook base and extending a distance therefrom; and means for removably connecting the hook to a portion of the structure.

18. The musical instrument support of claim 17 wherein the support further comprises a handle having a first end connected to the upper surface of the support and a second end connected to the upper surface of the structure spaced a distance from the first end, and wherein the means for connecting the hook to the support further comprises:

a clip bar having a first end and a second end, the first end being removably connectable to the handle generally near the first end of the handle and the second end being removably connectable to the handle generally near the second end of the handle, the clip bar extending a distance generally between the first and second ends of the handle, the hook being removably connectable to the clip bar.

19. A musical instrument support removably connectable to a support having an upper surface, a front face and a rear face for cooperating with the support to support a musical instrument, comprising:

a first clip having a first portion engageable with a portion of the front face of the support and a second portion extending a distance generally over a portion of the upper surface of the support; and clip means connectable to a portion of the support and spaced a distance from the first clip;

stretch means connected to the second portion of the first clip and connected to a portion of the clip means for stretchably connecting the first clip to the clip means whereby the first clip and the clip means are stretchable in opposite directions thereby extending the distance therebetween so the first clip is disposable on the support and the clip means is connectable to the support, the stretch means biasing the first clip generally toward the clip means for maintaining the first clip engaged with the support and the clip means connected to the support; and support means on the first clip for cooperating to support the musical instrument when the first clip is engaged with the support and the clip means is connected to the support; and wherein the first clip further comprises:

a clip lip extendable over a portion of a front face of the support and engageable with the portion of the front face of the support and having opposite ends;

a clip plate having opposite ends with one end connected to one end of the clip lip and the clip plate extending from the clip lip the distance over the upper surface of the support, the stretch means being connected to the clip plate generally near the end thereof, opposite the end connected to the clip lip;

a clip base connected to the clip plate and having a first side and a second side and having a first opening extending therethrough intersecting the first and the second sides and a second opening extending therethrough intersecting the first and the second sides; and wherein the stretch means further comprises:

an elastomeric member having opposite ends with one end of the elastomeric member extending through the first opening in the clip base and the opposite end of the elastomeric member extending through the second opening in the clip base; and means for securing the opposite ends of the elastomeric member in the respective first and the second openings in the clip base.

20. The musical instrument support of claim 19 wherein the clip means further comprises:

a clip lip extendable over a portion of a rear face of the support and engageable with the portion of the rear face of the support and having opposite ends; and a clip plate having opposite ends with one end connected to one end of the clip lip and the clip plate extending from the clip lip the distance over the upper surface of the amplifier, the stretch means being connected to the clip plate generally near the end thereof, opposite the end connected to the clip lip; and means for connecting the elastomeric member to the second clip.

* * * * *

UNITED STATES PATENT AND TRADEMARK OFFICE

CERTIFICATE OF CORRECTION

PATENT NO. : 4,991,809

DATED : February 12, 1991

INVENTOR(S) : James R. Harkey

It is certified that error appears in the above-identified patent and that said Letters Patent is hereby corrected as shown below:

Column 2, line 47 the phrase "(FIG.31." should be --(FIG.3)--.

Column 6, line 6, the word "shorten" should be --shortened--.

Column 9, line 17, the word "mans" should be --means--.

Signed and Sealed this

Twenty-fifth Day of August, 1992

*Attest:*

*Attesting Officer*

DOUGLAS B. COMER

*Acting Commissioner of Patents and Trademarks*